US007365279B2

(12) United States Patent
Beerling

(10) Patent No.: US 7,365,279 B2
(45) Date of Patent: Apr. 29, 2008

(54) SYSTEM AND METHOD OF LOADING LIQUID METAL SWITCHES

(75) Inventor: Timothy Beerling, San Francisco, CA (US)

(73) Assignee: Agilent Technologies Inc., Santa Clara, CA (US)

( * ) Notice: Subject to any disclaimer, the term of this patent is extended or adjusted under 35 U.S.C. 154(b) by 0 days.

(21) Appl. No.: 11/358,627

(22) Filed: Feb. 21, 2006

(65) Prior Publication Data

US 2007/0193864 A1 Aug. 23, 2007

(51) Int. Cl.
*H01H 29/00* (2006.01)

(52) U.S. Cl. ..... 200/182; 200/193

(58) Field of Classification Search ..... 200/182–193, 200/220–228

See application file for complete search history.

(56) References Cited

U.S. PATENT DOCUMENTS 7,211,754 B2 * 5/2007 Wang et al. ..... 200/182
2006/0024504 A1 * 2/2006 Nelson et al. ..... 428/409
2006/0160206 A1 * 7/2006 Holmquist et al. ..... 435/287.2
2006/0164490 A1 * 7/2006 Kim et al. ..... 347/103
2006/0260919 A1 * 11/2006 Aimi et al. ..... 200/83 F

OTHER PUBLICATIONS

U.S. Appl. No. 11/130,846.
U.S. Appl. No. 11/130, 846.

* cited by examiner

*Primary Examiner*—Anh Mai
*Assistant Examiner*—Lisa Klaus

(57) ABSTRACT

The delivery of liquid to a device, for example, a microswitch, can be achieved without the application of external pressure to the liquid by using capillary action to cause the liquid to move as desired. In one embodiment, at least one channel having a wettable surface is created that allows liquid metal to flow into a measuring reservoir without the liquid metal being pressurized and without applying other external forces on the liquid metal to facilitate its movement. A portion of the channel between the wettable channel and the reservoir is non-wettable and this non-wettable area, while allowing the metal to flow into the reservoir, acts to prevent the liquid from back-flowing from the reservoir to the channel. In one embodiment pressurized gas can be generated and applied to the liquid in the reservoir to facilitate the movement of the liquid from the reservoir to the switch cavity.

10 Claims, 4 Drawing Sheets

Chamber empty

Channel fills by wetting

Reservoir fills

Liquid pinches off

Pressure is applied

Liquid driven into channel

SYSTEM AND METHOD OF LOADING LIQUID METAL SWITCHES

CROSS-REFERENCE TO RELATED APPLICATIONS

The present application is related to co-pending and commonly assigned U.S. patent application Ser. No. 11/130,846, filed May 17, 2005, entitled "METHOD AND APPARATUS FOR FILLING A MICROSWITCH WITH LIQUID METAL"; and U.S. patent application Ser. No. 10/996,823, filed Nov. 24, 2004, entitled "LIQUID METAL SWITCH EMPLOYING ELECTROWETTING FOR ACTUATION AND ARCHITECTURE FOR IMPLEMENTING SAME", the disclosures of which are hereby incorporated herein by reference.

BACKGROUND

In has now become a matter of routine to use microfluidic and microelectromechanical systems (MEMS) in the design of many types of structures. Some of these structures, for one reason or another, require that a measured amount of liquid be inserted within the structure during the manufacturing process.

For example, one such structure that requires liquid is an electromechanical microswitch that uses liquid metal, such as mercury, or gallium, or indium alloys, and the like, to selectively bridge across electrical contacts to complete (or open) an electrical path. In such switches a cavity is created within the switch and the cavity is filled with the liquid metal. The above-identified co-pending and commonly assigned U.S. patent application Ser. No. 11/130,846, filed May 17, 2005, entitled "METHOD AND APPARATUS FOR FILLING A MICROSWITCH WITH LIQUID METAL", is an example of a method of delivering a measured amount of liquid to a device using pressure to transfer the liquid from a measuring reservoir to the device. In high volume production, this liquid filling operation can become costly and mechanically difficult to achieve, especially when it is required to deliver the liquid under pressure to the structure.

BRIEF SUMMARY

In accordance with the invention, the delivery of liquid to a device, for example, a microswitch, can be achieved without the application of external pressure to the liquid (such as pressurizing the liquid) by using capillary action to cause the liquid to move as desired.

DETAILED DESCRIPTION

Figure 1:
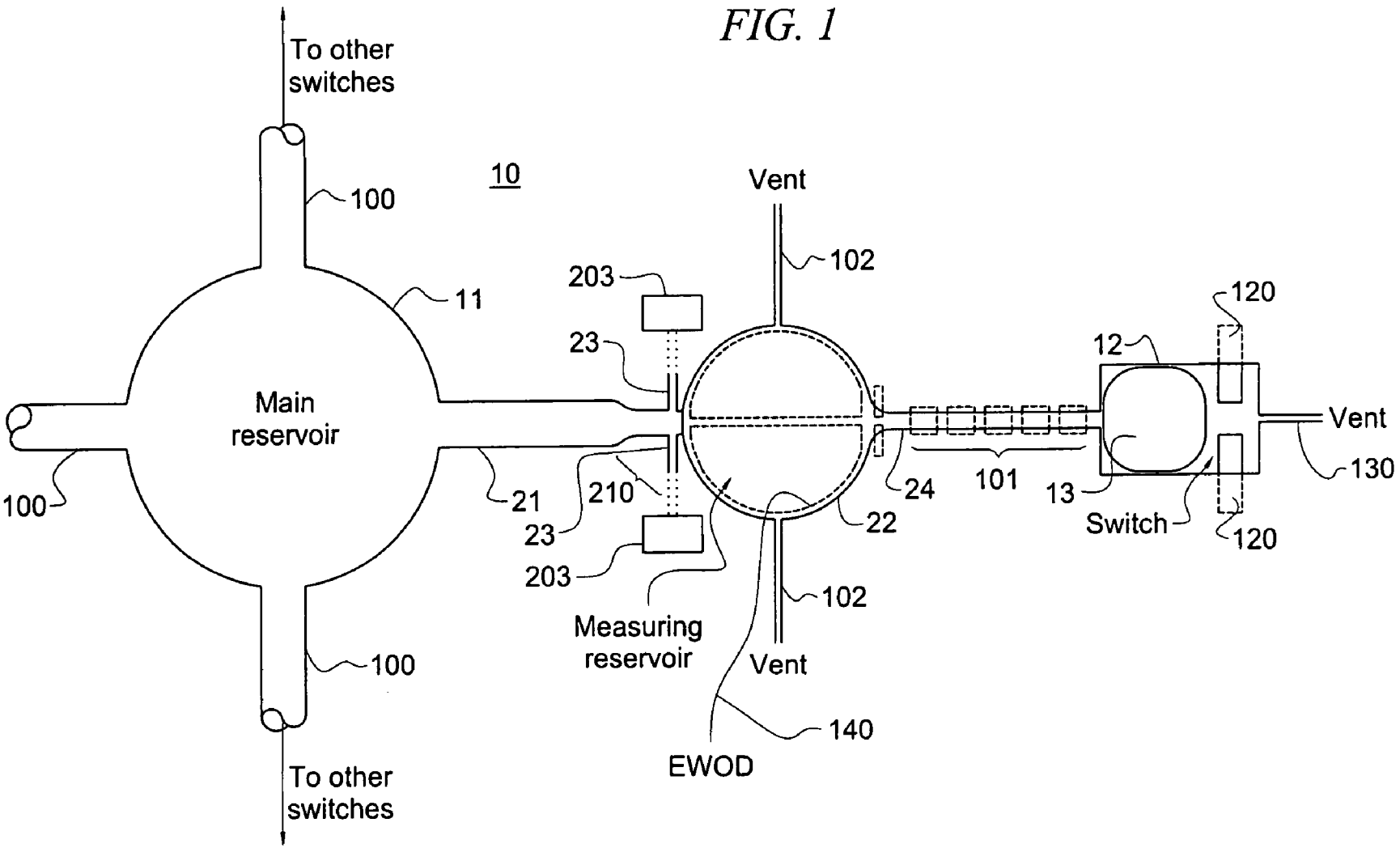
FIG. 1 shows one embodiment of a fluid delivery system.

FIG. 1 shows one embodiment 10 in accordance with the invention of a fluid delivery system operable for loading a measured quantity of liquid (such as liquid metal) into one or more devices, such as microswitch device 12. While not shown, a plurality of such devices would be fabricated on a single wafer or bonded wafer pair. In such an arrangement, numerous microswitch cavities must be filled essentially concurrently with liquid metal, devices and the technique discussed herein simplifies the process. Microswitch device 12 could be, for example, an RF switch having an input port and one or more switchable output ports.

Filing system 10 is shown from above and is defined in part by numerous walls, channels, cavities, and other surfaces typically formed (e.g., etched) from a substrate material (or a combination of substrates) such as silicon or borosilicate glass. Filing system 10 includes main reservoir 11 used to hold a large amount of liquid metal (not shown) typically enough for the number of device cavities it is designed to service, such as cavity 13 of device 12, with perhaps some reserve. Main reservoir 11 is configured to be loaded using conventional techniques, such as nozzle or needle injection, and will typically include one or more ports (not shown) to accommodate delivery of the liquid metal.

Although shown having curved side walls, reservoir 11 (and indeed any of the channels, reservoirs, or cavities illustrated) can be implemented using any desired shape or configuration. Main reservoir 11 can also be connected via a number of channels (such as channels 100), capillaries, or conduits to other devices, thereby servicing multiple devices and simplifying the overall process of delivering liquid metal to each of the devices. Note that not all devices need be of the same type or require the same volume of liquid, since each channel will have its own measuring reservoir, such as measuring reservoir 22.

Channel 21 leading from reservoir 11 is coupled to secondary or measuring reservoir 22, sized to contain the correct volume of liquid for the device it serves. Secondary reservoir 22 is an effective way to control the delivered liquid volume. Secondary reservoir 22 can generally take any shape, and in some embodiments can be designed to have a volume greater than the volume desired for the liquid metal droplet used in cavity(ies) 13. Secondary reservoir 22 is filled, as discussed with respect to FIGS. 2A-2D, by allowing the liquid metal to flow from reservoir 11 within channel 21 because of the wettable surface of channel 21. This process can be assisted by using electrowetting techniques, e.g., one or more electrodes (not shown) located along channel 21 to increase the wettability of the surface to move liquid metal as described above.

Figure 2:
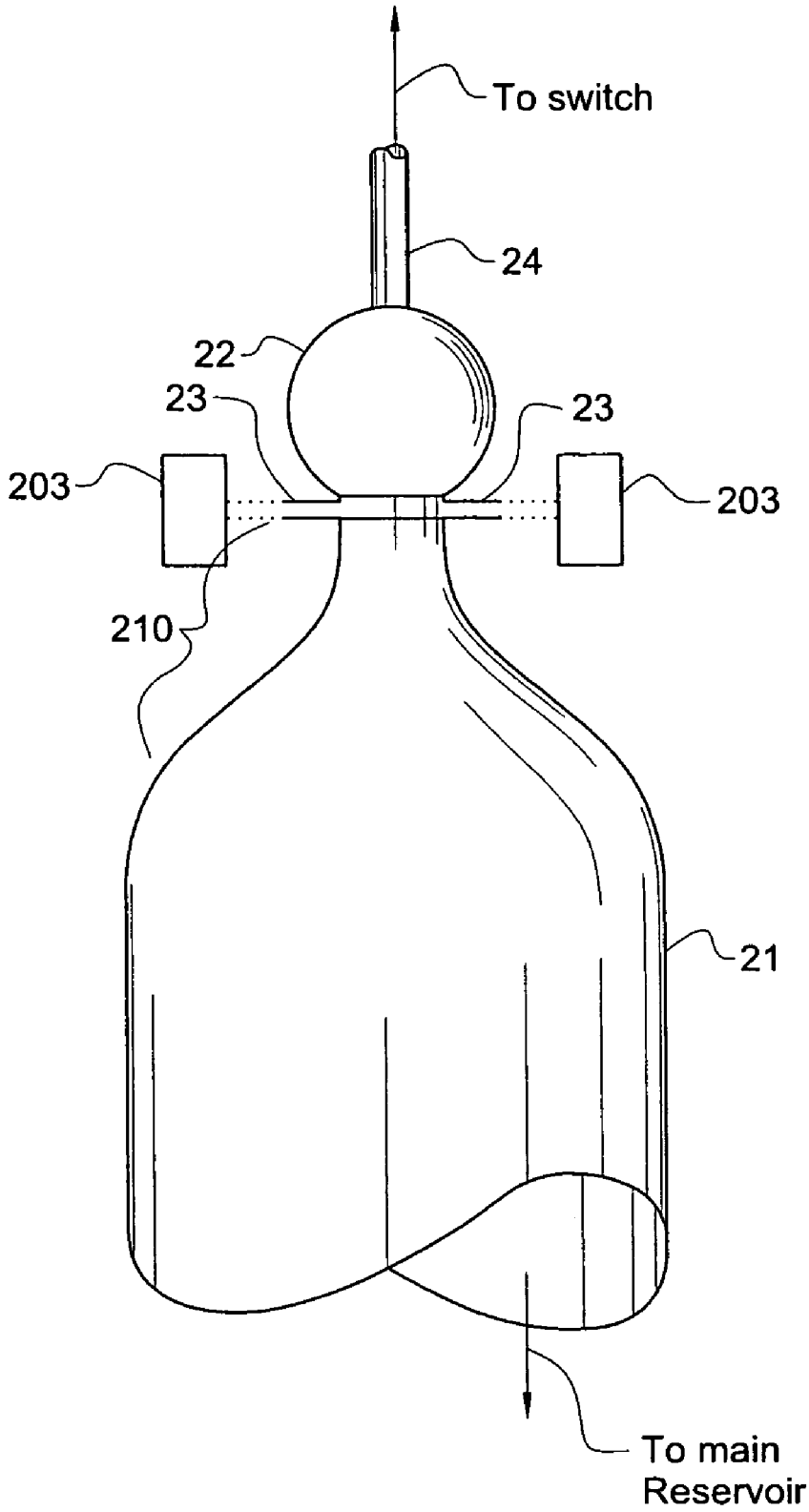
FIG. 2 shows an expanded view of the wettable and non-wettable regions of the fluid delivery system of FIG. 1.

FIG. 2 shows an expanded view of the wettable (21) and non-wettable (210) portions of channel 21. Channel 21, as discussed, has a wettable floor to draw the liquid from main reservoir 11 to measured reservoir 22 by capillary forces along the wettable region. In one embodiment, exposed metal thin films on the floor of channel 21 creates this wettability (liquid metals will typically be non-wetting to the dielectrics used in fabrication, and wetting to clean metal surfaces). By using wetting in the capillary channels an external pressure is not required to move the liquid between the main reservoir and the measured reservoir.

At the measuring reservoir, the wettability of the floor is controlled by electrowetting, such as Electrowetting On Dielectric (EWOD) 140 (FIG. 1). The EWOD control may or may not be required, depending on the size of the reservoir being filled. EWOD can also be used in the channel between the measuring reservoir and the device to be filled, as seen with 101.

Region 210, between measuring reservoir 22 and wettable channel 21 is a non-wetting region. In one embodiment, region 210 is smaller in diameter than is channel 21. Region 210 acts as will be discussed hereinafter) to pinch-off the liquid once the liquid passes the non-wettable region, thereby isolating the liquid metal in the reservoir in a stable state. A slightly positive pressure burst, created, for example, by a joule heating element, such as heating element 203, connected to channel 21 via channel 23, can help pinch off the fluid in the neck, thereby isolating liquid in the measuring reservoir. Note also that vents 102 (FIG. 1) can be used with joule heating elements, if required.

Figure 3A:
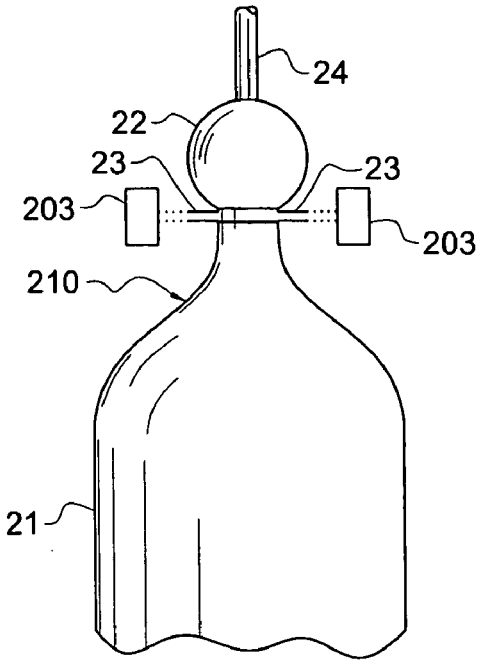
FIGS. 3A-3D illustrate the movement of liquid along the channel between a main reservoir and a measuring reservoir in the fluid delivery system of FIG. 1.
Figure 3B:
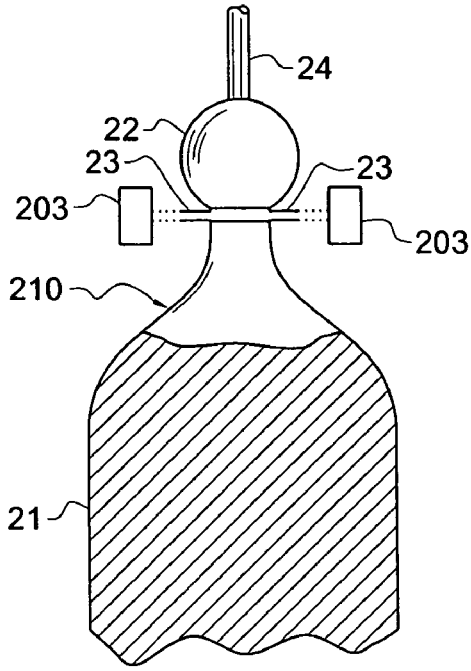
Figure 3C:
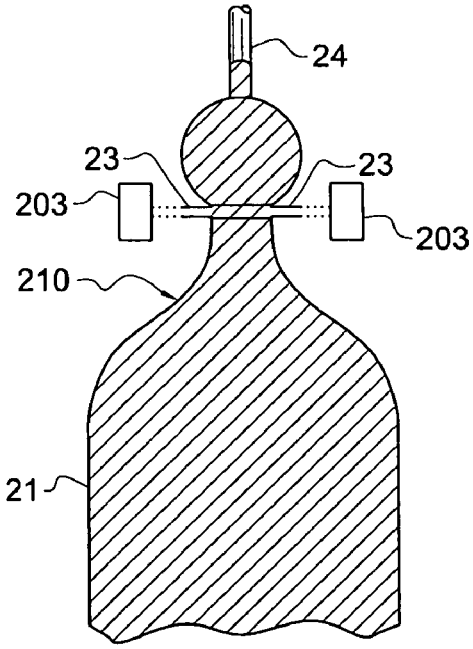
Figure 3D:
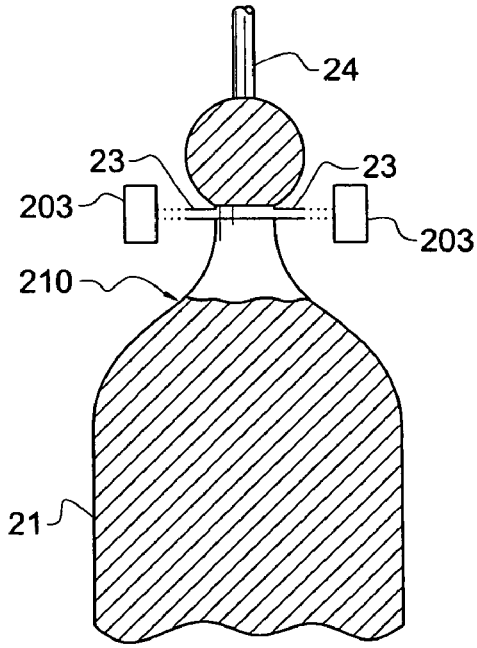

FIGS. 3A-3D illustrate the movement of liquid along channel 21 to reservoir 22. Liquid metal (the cross-hatched area of FIG. 3B) moves along the wettable regions of channel 21. As the liquid approaches non-wetting region 210 its momentum drives it across the non-wettable region (FIG. 3C) and into reservoir 22. Due to the non-wetting region, the liquid, as it crosses the non-wettable region, pinches into two segments, one segment filling reservoir 22 and the other segment remaining in channel 21, as shown in FIG. 3D. The menisci formed by the side vents 23 also help pinch the slug into two segments. The segment in reservoir 22 is now isolated from channel 21 by non-wettable region 210 and cannot back-flow into channel 21 unless a very high pressure is applied to the liquid metal in reservoir 22. There are vents 102 (FIG. 1) in reservoir 22 to allow trapped gas to escape, thereby allowing the reservoir to be totally filled with liquid metal. The reservoir filling process takes approximately a few milliseconds.

Figure 4A:
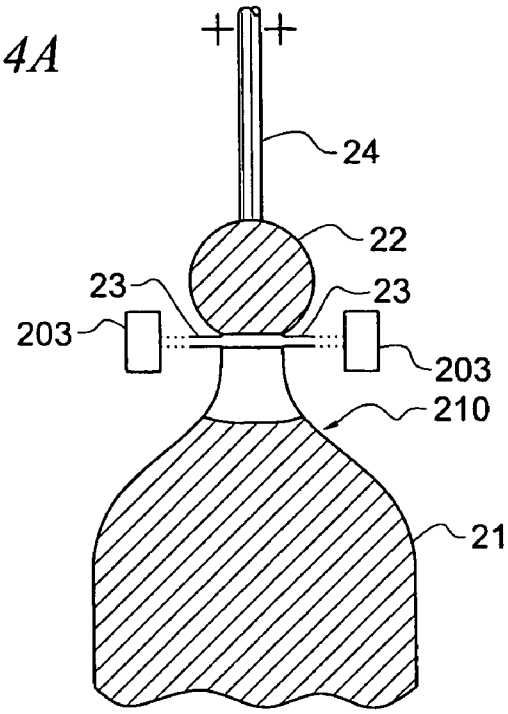
FIGS. 4A and 4B illustrate movement of liquid from the measuring reservoir to a device to be filled.
Figure 4B:
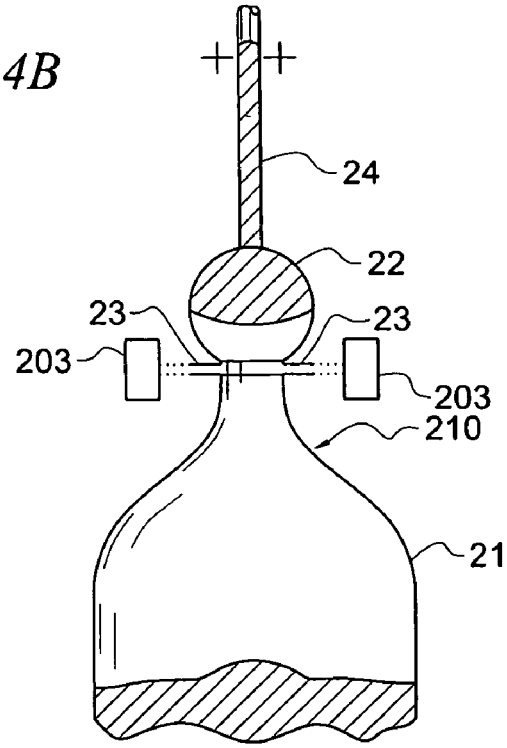

FIGS. 4A and 4B illustrate movement of the liquid metal from reservoir 22 toward the device to be filled. This movement can be, if desired, facilitated by heat from joule heating elements, connected to channel 21 by channel 23. The joule heating elements are thin film heaters which, in turn, then heat gas around the thin film. As will be discussed, the heated gas applies pressure to the liquid to assist the liquid in moving toward the cavity. A given heater may be shared by two (or more) liquid loading systems, if desired.

As the gas around the liquid is heated, it applies a pressure to the liquid metal. The liquid metal is then driven from the measuring reservoir, through microfluidic channel 24 and into the device to be filled (not shown in FIGS. 4A or 4B). When loading is complete, reservoir 22 and channel 21, which are partly filled with unused liquid metal as shown in FIG. 4B, can be cut away since they are not required for switch operation.

The liquid in wettable region 21 as seen in FIG. 4B, recedes from the application of pressure to the liquid metal, but this is unimportant, provided the liquid continues to provide a seal between the reservoirs. This seal is maintained because of the wetting between the liquid and the side wall (as shown in FIGS. 3B, 3C, 3D, 4A, and 4B) of region 21. This seal prevents pressurized gas from escaping between the liquid and the sidewall. The channel cross-section to the device to be filled should be chosen so that the pressure required to load the device does not cause the liquid in channel 21 to completely evacuate, or dewet from the sidewalls. For many microfluidic devices, this pressure is on the order of about one half of one atmosphere.

Numerous techniques can be used to render the surfaces of the channels non-wetting for liquid metals, a typical one being the formation of an $SiO_2$ layer along the walls of the channels. Additionally, the size or shape of the channel opening at main reservoir 11 and measuring reservoir 22 can be selected to encourage liquid metal to remain on one side or the other of the passage based on surface tension effects and contact angle.

Although the present invention and its advantages have been described in detail, it should be understood that various changes, substitutions and alterations can be made herein without departing from the spirit and scope of the invention as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

What is claimed is:

1. A structure for delivering a pre-established volume of a liquid metal to a substantially enclosed device, said structure comprising:

at least one reservoir defining a pre-established volume;

a device supply channel for delivering liquid metal contained within said reservoir to said device; and a reservoir supply channel for filling said reservoir, said supply channel comprising:

a wettable region and a non-wettable region, said non-wettable region between said wettable region of said supply channel and said reservoir.

2. The structure of claim 1 further comprising:

at least one heating element positioned with respect to said reservoir so as to heat gas contained within said reservoir.

3. The structure of claim 2 wherein said heating element comprises:

at least one joule heating element adapted to controllably apply said heat.

4. The structure of claim 1 wherein said substantially enclosed device is a microelectromechanical systems (MEMS) switch and said liquid metal forms at least a part of said switch's contacts.

5. The structure of claim 1 further comprising:

at least one electrowetting on dielectric (EWOD) device for facilitating said delivering of said liquid metal.

6. The structure of claim 1 wherein said non-wettable area is adapted to controllably constrict.

7. The structure of claim 1 wherein the cross-section of said device supply channel is large enough to allow a liquid metal-flow resistance in said device supply channel lower than the liquid metal-flow resistance of said non-wettable area of said reservoir supply channel.

8. The structure of claim 1 wherein the cross-section of said non-wettable area of said reservoir supply channel is smaller than the cross-section of said wettable area of said reservoir supply channel.

9. The structure of claim 1 wherein said reservoir has at least one wettable area.

10. The structure of claim 9 wherein said reservoir wettable area is electrowetted.

* * * * *

UNITED STATES PATENT AND TRADEMARK OFFICE

CERTIFICATE OF CORRECTION

PATENT NO. : 7,365,279 B2
APPLICATION NO. : 11/358627
DATED : April 29, 2008
INVENTOR(S) : Beerling It is certified that error appears in the above-identified patent and that said Letters Patent is hereby corrected as shown below:

On the Title page, in field (56), under "Other Publications", in column 2, line 2, delete "U.S. Appl. No. 11/130, 846."

Signed and Sealed this

Fourteenth Day of October, 2008

JON W. DUDAS
*Director of the United States Patent and Trademark Office*